US005500571A

United States Patent [19]

Okada et al.

[11] Patent Number: 5,500,571

[45] Date of Patent: Mar. 19, 1996

[54] METAL VAPOR DISCHARGE LAMP

[75] Inventors: Atsunori Okada; Shigeaki Wada; Shigekazu Kusanagi; Tohru Fujioka, all of Kadoma, Japan

[73] Assignee: Matsushita Electric Works, Ltd., Osaka, Japan

[21] Appl. No.: 265,784

[22] Filed: Jun. 27, 1994

[30] Foreign Application Priority Data

Jun. 29, 1993 [JP] Japan ..... 5-159447

[51] Int. Cl.[6] ..... H01J 17/16; H01J 61/35; H01J 61/36; H01J 17/18

[52] U.S. Cl. ..... 313/635; 313/489; 313/623

[58] Field of Search ..... 313/635, 489, 313/641, 640, 113, 638, 623, 33; 372/33

[56] References Cited

U.S. PATENT DOCUMENTS

| | | | |
|---|---|---|---|
| Re. 30,165 | 12/1979 | Mason et al. . | |
| 3,334,261 | 8/1967 | Butler | 313/641 |
| 3,350,598 | 10/1967 | Corbin | 313/365 |
| 3,900,754 | 8/1975 | Mason et al. . | |
| 3,984,590 | 10/1976 | Mason et al. . | |
| 4,591,759 | 5/1986 | Chalek | 313/638 |
| 4,899,347 | 2/1990 | Kuchar | 372/33 |
| 5,021,711 | 6/1991 | Madden | 313/623 |
| 5,032,762 | 7/1991 | Spacil et al. . | |
| 5,168,193 | 12/1992 | Hoegler | 313/113 |
| 5,346,729 | 9/1994 | Pitts | 427/582 |

FOREIGN PATENT DOCUMENTS

| | | |
|---|---|---|
| 0442704 | 8/1991 | European Pat. Off. . |
| 49/88375 | 8/1974 | Japan . |
| 50/12881 | 2/1975 | Japan . |
| 50/12878 | 2/1975 | Japan . |
| 50/12877 | 2/1975 | Japan . |
| 51/36788 | 3/1976 | Japan . |
| 51/32079 | 3/1976 | Japan . |
| 52/51776 | 4/1977 | Japan . |
| 56/22041 | 3/1981 | Japan . |
| 3/238748 | 10/1991 | Japan . |

*Primary Examiner*—Sandra L. O'Shea
*Assistant Examiner*—Mack Haynes
*Attorney, Agent, or Firm*—Burns, Doane, Swecker & Mathis

[57] ABSTRACT

A metal vapor discharge lamp includes an arc tube having on an inner surface a coating of multi-layer construction including a layer preferably facing the interior discharge space of the arc tube and formed with a strongly covalent bonded material and at least another layer made to have a function of shielding water, whereby reaction of enclosed materials with the arc tube and oozing of water from the arc tube can be prevented, and cracking and peeling of the coating can be effectively prevented from occurring.

5 Claims, 2 Drawing Sheets

METAL VAPOR DISCHARGE LAMP

BACKGROUND OF THE INVENTION

This invention relates to metal vapor discharge lamps and, in particular, a metal vapor discharge lamp provided with a unique arc tube.

The metal vapor discharge lamps of the kind referred to have been widely utilized as such high pressure discharge lamps as a metal halide lamp and the like.

DESCRIPTION OF RELATED ART

In the metal vapor discharge lamps in recent years, there have been employed metal halide lamps in which one or a mixture of metal halides is further enclosed in a high pressure mercury lamp having an arc tube in which mercury and a rare gas are enclosed or a high pressure sodium lamp with a sodium metal charged therein, for the purpose of improving the color rendering or luminous efficiency of the mercury lamp. In these metal vapor discharge lamps, however, there has been a problem that, due to the fact that the arc tube reaches a high temperature during the burning of the lamp, reaction is caused to take place between the arc tube and the luminous materials so as to cause devitrification and the like phenomenon accompanying discoloration of the arc tube and crystallization of forming material of the arc tube, and the light transmission properties and strength of the arc tube are thereby deteriorated or the life of the lamp itself is shortened. Further, in the metal halide lamps, there has been another problem that halogen is left within the arc tube due to the dissoloving of the metal component of the metal halide into wall of the arc tube or disappearance of the metal as a result of reaction to the arc tube, the thus left halogen causing an ignition failure, extinction or the like phenomenon to occur due to the rise in the starting voltage or lamp voltage, so as to also shorten the life of the lamp.

In order to eliminate such problems, there has been suggested the metal vapor discharge lamp, the inner surface of the arc tube of which is covered with a coating. While such inner surface coating with one or a mixture of metal oxides in fine particles has been disclosed in Japanese Patent Laid-Open Publication No. 49-88375, 50-12877, 50-12878 or 51-32079, it has been difficult to obtain the coating having no deficiency in the surface in the case where the metal oxide coating is formed by the fine particles. In Japanese Patent Laid-Open Publications No. 50-12881 and 52-51776, on the other hand, there have been described other methods for obtaining the metal oxide coating involving no surface deficiency by means of such organic metallic compound as a metallic alcoholate or the like. Even with such methods of forming the oxide coating with the organic metallic compound, it has been still difficult to reduce the deficiency in the surface to a satisfiable extent.

In European Patent No. 0442704 A2, further, it has been suggested to form a more dense coating by means of metallic chelate compound with a plasma CVD employed. In Japanese Patent Laid-Open Publications No. 51-36788 and No. 56-22041, it is suggested to form the coating with silicon nitride, and Japanese Patent Laid-Open Publication No. 3-238748 discloses a coating formed by using diamond or diamond-like carbon. Further, in U.S. Pat. Nos. 3,900,754, 3,984,590 and Reissued 30,165, the coating is formed with a metallic salt glass in solution aspect which is spread and heated, while U.S. Pat. No. 5,032,762 shows a formation of the coating with beryllium oxide.

In the foregoing known methods, however, the coating on the inner surface of the arc tube has been all shown to be formed in a single layer, and there still remains a risk that the single layer coating is incapable to remove various factors of shortening the life of the lamp referred to. In the case of employing the metal halide, in particular, there has been a problem that water oozed from the arc tube during the burning of the lamp reacts to the metal halide so as to produce a metal oxide and hydrogen halide, the latter of which involves a risk that the lamp starting voltage is thereby raised to have the startability deteriorated, including the possibility that the lamp may not be lighted when the amount of hydrogen halide produced increases. Further, in forming the coating of the foregoing materials on the inner surface of the arc tube, a remarkable difference in the thermal expansion coefficient between the materials of the arc tube and coating causes a problem to arise in that the adhesion between the arc tube and the coating is deteriorated enough for rendering the cracking and peeling to occur.

SUMMARY OF THE INVENTION

The present invention is to overcome the foregoing problems and to provide a metal vapor discharge lamp which is capable of preventing any reaction of the arc tube to the enclosed material in the arc tube, restraining water production inside the arc tube, and thus preventing any cracking and peeling of the coating from occurring.

According to the present invention, the above object can be attained by means of a metal vapor discharge lamp in which luminous materials are enclosed in an arc tube, the inner surface of which tube is covered with a coating, characterized in that the coating is formed in a multi-layer construction, and at least one of the multi-layer construction other than a layer facing the interior discharge space is formed to have a function of shielding water.

Other objects and advantages of the present invention shall become clear as the description of the invention advances in the followings as detailed with reference to preferred embodiments shown in accompanying drawings.

DETAILED DESCRIPTION OF THE PREFERRED EMBODIMENTS

Figure 1:
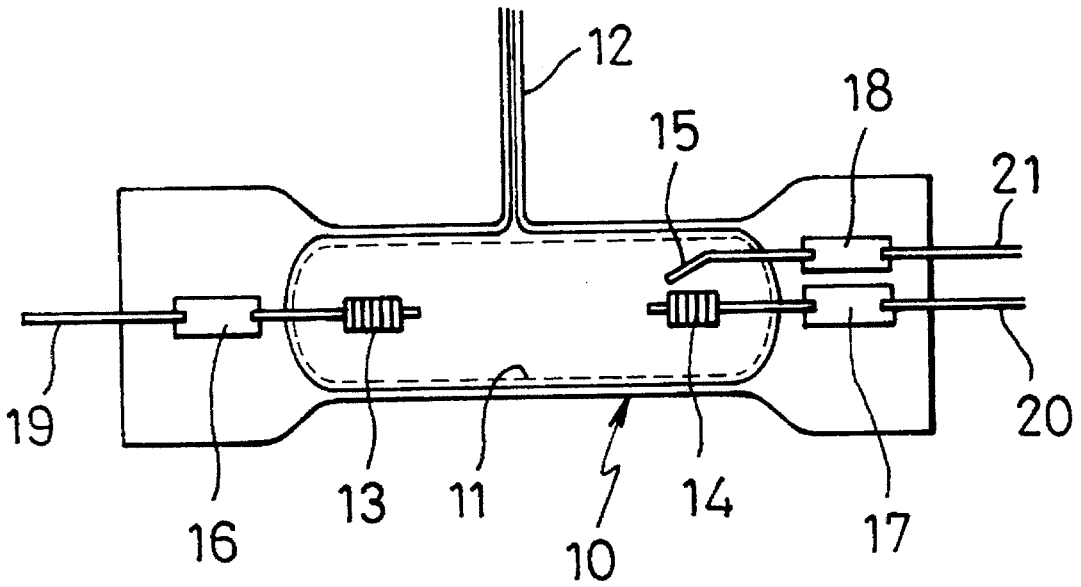
FIG. 1 shows in a schematic section an arc tube in an embodiment of the metal vapor discharge lamp according to the present invention.

Referring first to basic technical matters prior to the description of the embodiments of the present invention, in the metal vapor discharge lamp, for example, rare earth metal halides are widely employed as the luminous material, so as to improve the color rendering or the luminous efficiency of the lamp. Provided here that a quartz glass is employed for the arc tube and a rare earth metal halide is used as the luminous material, with the rare earth metal made trivalent, there arises a reaction represented as in the following, wherein the rare earth metal halide is in a dissociation into the rare earth metal M and halogen within a plasma being discharged:

$$M+SiO_2 \rightarrow aM_2O_3 \cdot bSiO_2+CSiO \quad (1)$$

$$2SiO \rightarrow SiO_2+Si \quad (2)$$

That is, the rare earth metal reacts to the quartz glass ($SiO_2$) and a complex oxide $aM_2O_3 \cdot bSiO_2$ and SiO are produced. At this time, SiO is in an unstable state and exists as a gas, but this SiO varies to be stable $SiO_2$ and Si. As SiO evaporates as the gas from the surface of the quartz glass, the surface is made to be in a state of etching, while $SiO_2$ formed from SiO is again crystallized on the surface of the quartz glass, and this recrystallized $SiO_2$, and the above referred complex oxide and the glass surface from which SiO has evaporated causes the devitrification to appear. As a result of analysis, it has been found that the recrystallized $SiO_2$ contains a cristobalite-like crystal which is different from the quartz glass in amorphous state, and, when the enclosed material includes CsI, a tridymite-like crystal in addition to the cristobalite-like crystal. Further, when alumina ($Al_2O_3$) permeable to light is employed for the arc tube, similar result of the reaction to the above formulas (1) and (2) is attained, substituting $Al_2O_3$ for $SiO_2$.

In view of these results, it has been found that even $Al_2O_3$ excellent in heat-resistance and in alkali-resistance reacts to the rare earth metals, as well as that the reaction is an ionic reaction between the metal oxide of the strong ionic bond and the rare earth metal ion. In view of the result, a coating was formed on the inner surface of the arc tube with a material of weak ionic bond, high chemical stability, and dense and strong covalent bond, and this arc tube having thus formed coating was experimentally burned, and outcome of which has shown that the devitrification represented by the formulas (1) and (2) could be effectively restrained. For the index showing the degree of the covalent bonded material used, in particular, the material having a difference in electronegativity less than 2.0 between constituent elements of the material employed has shown an excellent result.

An excellent metal halide discharge lamp showing less rise in the starting voltage and no deterioration in the optical transmission due to the devitrification could be obtained by providing on the arc tube the inner coating which comprises the first layer exposed to the interior discharge space of the arc tube and formed by such strongly covalent bonded material as in the above and a further layer of silicon nitride ($Si_3N_4$) provided behind or on inner side of the exposed layer for shielding water emitted from the arc tube to the discharge space. In accordance with the difference in the thermal expansion coefficient of the material between the respective layers of the coating, an additional layer of a material of an intermediate value of the difference in the thermal expansion coefficient is interposed as a thermal expansion coefficient adjusting layer, so that the coating in the multi-layer construction can be prevented from involving any cracking and peeling.

Referring now to FIG. 1, there is shown an arc tube 10 for the metal vapor discharge lamp according to the present invention, in which a coating 11 of the multi-layer construction is provided on the inner surface of the arc tube 10, then this arc tube 10 is cut in a predetermined length, the interior space of the arc tube 10 is vacuumed through an exhaust pipe 12, and the enclosed materials (luminous material, mercury, rare gas and the like) are charged and sealed in the tube 10. Referring more specifically to the arc tube 10, main electrodes 13 and 14 are provided to extend from both longitudinal ends of the arc tube 10 inward to oppose each other, and a start assisting electrode 15 is also provided to be adjacent to one electrode 14. These electrodes 13–15 are connected respectively to each of foil members 16–18 optimumly of molybdenum, which members 16–18 are connected through their lead wires 19–21 to an external circuit (not shown).

Figure 2:
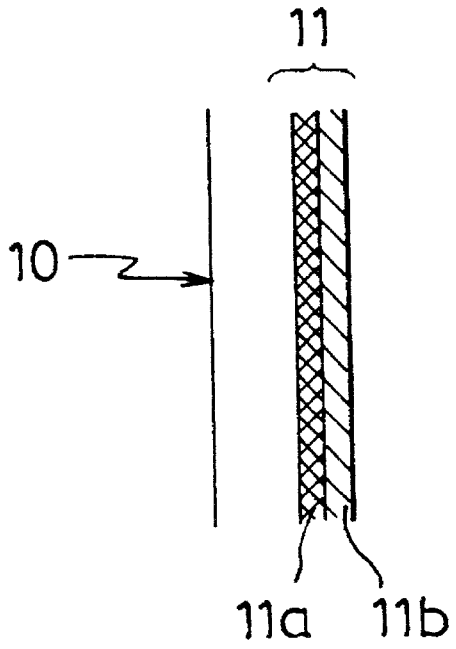
FIG. 2 is a fragmentary section of tube wall in the arc tube of FIG. 1.

Referring more specifically to this embodiment with reference to FIG. 2, the arc tube 10 of the metal vapor discharge lamp is formed in its tube body by quartz glass, high silicate glass, optically transmissible ceramics or single crystal ceramic. The coating 11 of multi-layer construction is provided on the inner surface of the tube body of the arc tube 10, and this coating 11 comprises a layer **11*b* on the interior discharge space side of a strongly covalent bonded material for preventing any reaction thereto of such enclosed material in the interior discharge space such as a metal halide, and a layer 11*a* of $Si_3N_4$ on the arc tube body side for preventing water from being emitted from the arc tube. In respect of the silicon nitride layer 11*a*, the layer was formed through the CVD process of a mixture gas of $NH_3$ and $SiH_4$, but the material and process for forming the $Si_3N_4$ layer 11a should not be required to be limited to them. For the strongly covalent bonded material layer 11*b***, the silicon carbide (SIC) layer was formed with a mixture gas of $CH_4$ and $SiH_4$ through the CVD process, while the material and process for forming this SiC layer should not be limited to the above.

After thus forming on the inner surface of the arc tube 10 the coating 11 in the multi-layer construction, the interior of the arc tube 10 was vacuumed, 9 mg of $DyI_3$, 5 mg of $NdI_3$, 6 mg of CsI, 40 mg of mercury and 30 Torr of Ar gas were then enclosed in the vacuumed tube as the enclosed materials, and a metal halide discharge lamp of a type of an input 250W was prepared. This lamp was lit for 6,000 hours with a ballast of 250W, after which the luminous flux maintenance factor was 80%, whereas a comparative lamp was concurrently prepared with the same enclosed materials in the same size of the lamp but without forming any coating on the inner surface of the arc tube and was lit for 6,000 hours under the same conditions as in the above, after which the luminous flux maintenance factor of this comparative lamp was 41%. In order to compare the starting voltage, further, the same lamp as in the above lamp but having the coating which comprised only the SiC layer, without the layer of silicon nitride $Si_3N_4$. At this time, all lamps prepared were lit within a range of 140V to 150V, and their starting voltage after the lighting for 6,000 hours was detected for comparison, detections of which were more than 200V for the lamp having no coating, more than 185V for the lamp having the coating of only SiC layer, and less than 170V for the lamp of the instant embodiment according to the present invention.

In another embodiment of the present invention, the interior space side layer **11*b* of the strongly covalent bonded material in the multi-layer coating is formed as a BN layer, through the CVD process with a material consisting of a mixture gas of $BH_3 \cdot N(C_2H_5)_3$ (liquid material) with a carrier gas consisting of Ar gas and $NH_3$, in contrast to the embodiment of FIGS. 1 and 2. Here, the material and process for forming the BN layer are not limited to those herein described. In the present instance, too, the similar lamp to that of FIGS. 1 and 2 was subjected to the similar test, as a result of which it has been observed that the luminous flux maintenance factor after the lighting for 6,000 hours was 83% and, for the starting voltage, the lamp having the coating including only the BN layer 11*b* required more than 180V but the lamp having the coating including both the $Si_3N_4$ layer 11*a* and the BN layer 11*b*** could be started at a voltage less than 170V.

In still another embodiment of the present invention, the interior space side layer **11*b* of the high covalent bonding material is formed as a diamond-like carbon (DLC) layer or a diamond layer, through the CVD process with a mixture gas of $H_2$ and $CH_4$, in contrast to the embodiment of FIGS. 1 and 2. The material and process for forming the DLC layer or the diamond layer are not limited to those referred to in the above. In this case, too, as a result of the similar test made by the similar lamp to that in the embodiment of FIGS. 1 and 2, the luminous flux maintanance factor after being lit for 6,000 hours was 84% and, for the starting voltage, the lamp having the coating of only the DLC layer 11***b* required more than 180V but the lamp having the coating of both the $Si_3N_4$ layer 11*a* and DLC layer 11*b* could be started at a voltage less thorn 170V.

Figure 3:
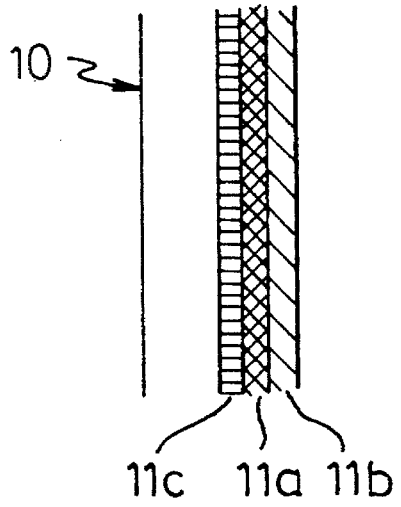
FIGS. 3 to 5 are respectively a fragmentary section of the tube wall in the arc tube in each of other embodiments according to the present invention.

Referring now to FIG. 3, there is shown another embodiment of the present invention, in which there is taken a measure for coping with the case involving a difference in the thermal expansion coefficient between the arc tube and the coating. More specifically, the arc tube 10 in an event where the tube wall material is quartz glass, its thermal expansion coefficient is about $0.55\times10^{-6}$/° C. while the thermal expansion coefficient of the silicon nitride layer 11*a* for restraining water emission from quartz is about $3.2\times10^{-6}$/° C., and their difference is large. In the present embodiment, (the material of the layer functioning to regulate the thermal expansion coefficient is a metal oxide), and a mixture solution of metal alcoholate employed in coating with a metal oxide was used. This mixture solution was of an Si alcoholate $Si(OR)_4$ for preparing $SiO_2$ and an Al alcoholate $Al(OR)_3$ for preparing $Al_2O_3$. Here, R denotes alkyl group. Spreading this mixture solution on the inner wall surface of the arc tube 10, drying the spread solution, and sintering thus dried layer of the solution, a coating of metal oxide was obtained, while the thermal expansion coefficient of the coating could be varied from $0.55\times10^{-6}$/° C. of $SiO_2$ to $8\times10^{-6}$/° C. of $Al_2O_3$ by varying the mixture ratio of the mixture solution. At this time, to use Mg(OK) other than $Al(OR)_3$ allows the variation made to be up to $16\times10^{-6}$/° C.

Referring to the above more in detail, the coating 11 in the multi-layer construction is formed on the inner surface of the arc tube 10 made of quartz, by forming first on the surface of the arc tube 10 the thermal expansion coefficient regulating layer 11*c* of a mixture metal oxide of $Si(OR)_4$ and $Al(OR)_3$, for example, and regulated in the thermal expansion coefficient to be 1.8 to $2.0\times10^{-6}$/° C., next on this layer 11c the same $Si_3N_4$ layer 11*a* as in the foregoing embodiment of FIGS. 1 and 2, and further on this layer 11*a* the high covalent bonding layer 11*b* to be exposed to the discharge space. In this case, too, the same lamp as in the foregoing embodiment of FIGS. 1 and 2 were used but subjected to a test of repeating a lighting ON/OFF cycle of lighting ON for 2 hours and 30 minutes and lighting OFF for 30 minutes, for a total test time of about 2,000 hours. As a result, the arc tube having no thermal expansion coefficient regulating layer 11*c* caused the cracking or peeling of the coating, but the arc tube 10 of the present embodiment having the layer 11*c* could effectively prevent the cracking or peeling from occurring. While in the present embodiment the thermal-expansion coefficient regulating layer 11*c* has been referred to as being disposed between the tube wall of the arc tube 10 and the coating 11 of the multi-layer construction, but it is also possible to incorporate the regulating layer 11*c* into the multi-layer construction of the coating as formed between the $Si_3N_4$ layer 11*a* and the high covalent bonding layer 11*b*, so as to improve the adhesion between both layers 11*a* and 11*b*.

Figure 4:
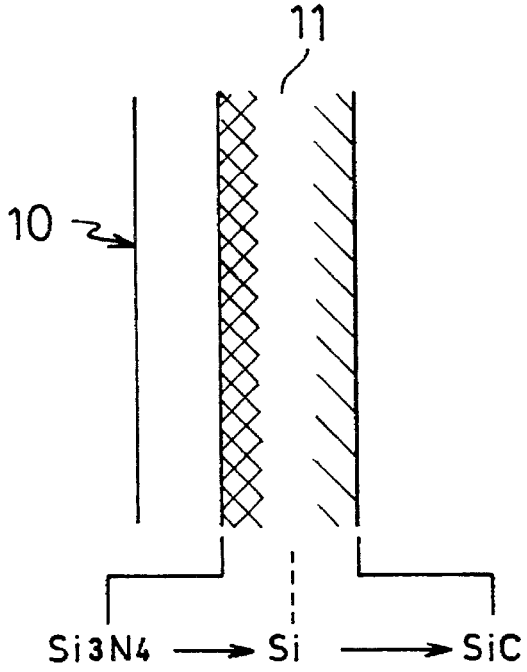

In still another embodiment of the present invention, there is taken a measure for improving the adhesion of the coating to the tube wall of the arc tube. Referring thereto with references to FIG. 4, the $Si_3N_4$ layer 11*a* was first formed on the tube wall of the arc tube 10 up to a predetermined thickness, and the mixture gas for forming this layer 11*a* was further kept applied onto the layer while having, among the components of the gas, $NH_3$ gradually reduced in the mixing ratio but, once the amount of $NH_3$ has reached zero, adding $CH_4$ with its mixing ratio gradually increased, while maintaining the ratio of $SiH_3$ unchanged. As a result, the $Si_3N_4$ layer is sufficiently formed at the position of directly contacting the wall of the arc tube 10 but Si content increases as the position comes closer to the interior discharge space, and the innermost side layer exposed to the discharge space is of SiC.

Figure 5:
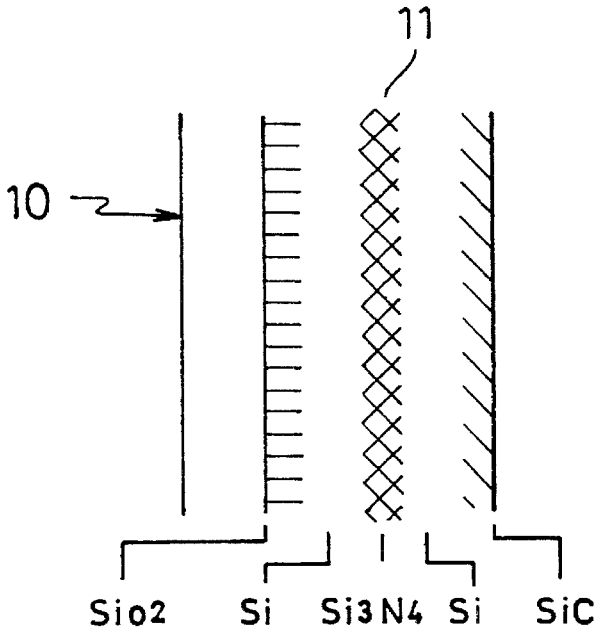

In coping with the difference in the thermal expansion coefficient of the material between the arc tube 10 and the coating 11 of the multi-layer construction, the present embodiment is to first provide $SiO_2$ layer of the same composition as the quartz glass on the inner surface of the tube wall of the quartz glass by means of the CVD process employing a mixture gas of $SiH_4$ and $N_2O$. Referring more specifically by references to FIG. 5, the $SiO_2$ layer is formed with the mixture gas of $SiH_4$ and $N_2O$ directly on the arc tube wall of quartz glass, thereafter the process is continued with the mixture gas gradually reduced in the mixing ratio of only $N_2O$ until its ratio reaches zero and then gradually increased in the mixing ratio of only $NH_3$ to form the $Si_3N_4$ layer. Then $NH_3$ is gradually reduced to reach zero, and thereafter $CH_4$ is gradually increased to form the SiC layer. Consequently, the arc tube 10 is provided with the coating 11 of the multi-layer construction including the $SiO_2$ layer formed on the inner arc tube wall surface, with the same composition and the same thermal expansion coefficient as the quartz glass and sequential layers in the order of $Si\rightarrow Si_3N_4\rightarrow Si\rightarrow SiC$ towards the innermost side exposed to the discharge space, the coating being thus made extremely excellent in the adhesion by the thermal expansion coefficient sequentially varied. In this case, too, the same lamp as those in the foregoing embodiment of FIGS. 1 and 2 was prepared and subjected to the test of lighting ON/OFF with repeated cycles of 2 hours and 30 minutes ON and 30 minutes OFF for about 4,000 hours in total, and the coating 11 caused no cracking nor peeling. It should be appreciated that the materials employed in the present embodiment may not be limited to those described but be replaced by various other materials, and that, while in the foregoing embodiments the metal vapor discharge lamp has been referred to as one having electrodes, the characteristic arrangement of the present invention can achieve the same effect even when applied to an electrodeless type metal vapor discharge lamp.

What is claimed is:

1. A metal vapor discharge lamp comprising an arc tube, a luminous material consisting of a rare earth metal halide and enclosed in the interior discharge space of said arc tube, and a coating of a multi-layer construction covering the inner surface of said arc tube, said coating including at least a layer formed on the inner surface of the arc tube with silicon nitride for shielding water emitted from the arc tube, and an innermost layer exposed to the interior discharge space of the arc tube and formed with boron nitride as a strongly covalent bond material.

2. The lamp according to 1 wherein said coating includes a further layer interposed between said water shielding layer and said innermost layer, said further layer functioning to regulate the thermal expansion coefficient of the coating.

3. The lamp according to claim 2 wherein said further layer is formed of a functionally gradient material showing sequential variation.

4. The lamp according to claim 2 wherein said multi-layer construction of said coating is formed through a vapor growth process with a mixture gas, with a mixing ratio of said mixture gas varied.

5. The lamp according to claim 1 wherein said arc tube is formed of quartz glass.

* * * * *